US008506344B2

(12) United States Patent
Chan et al.

(10) Patent No.: US 8,506,344 B2
(45) Date of Patent: Aug. 13, 2013

(54) RECONFIGURABLE CLOTHING ARTICLE FOR A DOLL

(75) Inventors: Patricia Chan, Redondo Beach, CA (US); Angelica Lee Northrup, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 253 days.

(21) Appl. No.: 12/766,644

(22) Filed: Apr. 23, 2010

(65) Prior Publication Data

US 2011/0111669 A1 May 12, 2011

Related U.S. Application Data

(60) Provisional application No. 61/214,769, filed on Apr. 27, 2009.

(51) Int. Cl.
*A63H 3/00* (2006.01)
*A63H 3/12* (2006.01)

(52) U.S. Cl.
USPC ..... 446/321; 446/98; 446/268

(58) Field of Classification Search
USPC ..... 446/72, 98, 268, 321; D21/577
See application file for complete search history.

(56) References Cited

U.S. PATENT DOCUMENTS

| | | | | | |
|---|---|---|---|---|---|
| 1,148,540 | A | | 8/1915 | Sancier | |
| 1,396,766 | A | | 11/1921 | McClelland | |
| 1,407,165 | A | | 2/1922 | Pajeau | |
| 1,437,467 | A | * | 12/1922 | Dykman | 446/74 |
| D65,838 | S | * | 10/1924 | Stevens | D21/627 |
| 1,583,284 | A | * | 5/1926 | Dykman | 446/74 |
| 1,784,369 | A | | 12/1930 | Lowenbaum | |
| 1,966,986 | A | | 7/1934 | Martin | |
| 2,195,127 | A | | 3/1940 | Brucker | |
| 2,274,303 | A | | 2/1942 | Ornstein | |
| 2,325,750 | A | | 8/1943 | De Vries | |
| 2,380,175 | A | | 7/1945 | Hawkey | |
| 2,697,224 | A | * | 12/1954 | Aidenland | 2/71 |
| 2,825,905 | A | | 3/1958 | Merl | |

(Continued)

FOREIGN PATENT DOCUMENTS

| | | | |
|---|---|---|---|
| JP | 62-56070 | U | 4/1987 |
| JP | 63-8090 | U | 1/1988 |

(Continued)

OTHER PUBLICATIONS

International Preliminary Report on Patentability for Application No. PCT/US2010/032388, 6 pages, dated Nov. 1, 2011.

(Continued)

*Primary Examiner* — Gene Kim
*Assistant Examiner* — Alyssa Hylinski
(74) *Attorney, Agent, or Firm* — Edell, Shapiro & Finnan LLC

(57) ABSTRACT

A doll includes a reconfigurable clothing article coupled thereto. The reconfigurable clothing article can be placed in different configurations relative to the body of the doll. In one configuration, the clothing article can be moved upward and substantially cover an upper portion of the doll body. In another configuration, the clothing article can be moved downward and substantially cover a lower portion of the doll body. In one embodiment, the clothing article may include openings or receiving areas into which the arms of the doll can be inserted. In one embodiment, the clothing article may be placed in intermediate configurations along the body of the doll.

20 Claims, 6 Drawing Sheets

(56) References Cited

U.S. PATENT DOCUMENTS

| | | | | | |
|---|---|---|---|---|---|
| 3,851,419 | A | | 12/1974 | Kaelin | |
| 4,107,873 | A | | 8/1978 | Bauer | |
| 4,168,592 | A | | 9/1979 | Merino | |
| 4,227,264 | A | | 10/1980 | Spector et al. | |
| 4,336,665 | A | | 6/1982 | Moreau | |
| 4,614,505 | A | | 9/1986 | Schneider et al. | |
| 4,639,233 | A | * | 1/1987 | Brassfield | 446/321 |
| 4,695,264 | A | | 9/1987 | McLeod, Jr. | |
| 4,734,075 | A | | 3/1988 | Park | |
| 4,739,529 | A | | 4/1988 | Mills | |
| 4,866,791 | A | | 9/1989 | Carver et al. | |
| 4,867,729 | A | | 9/1989 | Weinman et al. | |
| 4,921,459 | A | | 5/1990 | Cook et al. | |
| D310,549 | S | * | 9/1990 | Rogers | D21/627 |
| 5,046,986 | A | | 9/1991 | Wood et al. | |
| 5,079,779 | A | * | 1/1992 | Spector et al. | 2/106 |
| 5,090,938 | A | | 2/1992 | Reynolds | |
| 5,115,528 | A | | 5/1992 | Lamle | |
| 5,127,107 | A | | 7/1992 | Wood et al. | |
| 5,149,289 | A | * | 9/1992 | Edwards et al. | 446/321 |
| 5,186,673 | A | | 2/1993 | Fogarty et al. | |
| 5,224,894 | A | * | 7/1993 | Nelson et al. | 446/73 |
| 5,328,400 | A | | 7/1994 | Bass | |
| 5,421,761 | A | | 6/1995 | Pitcher et al. | |
| 5,503,583 | A | * | 4/1996 | Hippely et al. | 446/14 |
| 5,649,848 | A | | 7/1997 | Clark | |
| 6,108,815 | A | | 8/2000 | Majerfeld | |
| 6,336,226 | B1 | | 1/2002 | Garcia | |
| 6,484,321 | B1 | | 11/2002 | Shamam | |
| 6,557,175 | B2 | | 5/2003 | Greenblatt | |
| 6,962,517 | B2 | | 11/2005 | Murray | |
| 2002/0088047 | A1 | | 7/2002 | Greenblatt | |
| 2003/0114074 | A1 | | 6/2003 | Bart et al. | |
| 2005/0164598 | A1 | * | 7/2005 | Kelsey | 446/296 |
| 2012/0289121 | A1 | | 11/2012 | Fiore | |

FOREIGN PATENT DOCUMENTS

| | | | |
|---|---|---|---|
| JP | 2002166061 | A | 6/2002 |
| KR | 10-1995-0010507 | B1 | 9/1995 |
| WO | 9305857 | A1 | 4/1993 |

OTHER PUBLICATIONS

International Search Report for PCT Patent Application No. PCT/US2010/032388, dated Jan. 3, 2011, 9 pages.

* cited by examiner

RECONFIGURABLE CLOTHING ARTICLE FOR A DOLL

CROSS-REFERENCE TO RELATED APPLICATION

This application claims priority to and the benefit of U.S. Provisional Patent Application No. 61/214,769, filed Apr. 27, 2009, entitled "Transforming Clothing Articles for Fashion Doll," the entire disclosure of which is incorporated herein by reference in its entirety.

FIELD OF THE INVENTION

This invention relates generally to fashion dolls and particularly to clothing and accessory articles used in combination therewith. This invention also relates to a reconfigurable or transformable article of clothing that can be used with a doll or figure.

BACKGROUND OF THE INVENTION

Fashion dolls have proven to be an extremely popular and long-lasting category of doll products through the years. The most popular fashion dolls provide generally elongated thin bodies formed of a molded plastic material. In most fashion dolls, at least some portions of the dolls include articulated joints to provide action and posability. Often the appearance factors such as facial characteristics and hairstyle of fashion dolls is exaggerated to provide enhanced play value for the child user. In attempting to improve the appeal of fashion dolls, practitioners in the toy arts have provided a virtually endless variety of play environments, accessories and clothing articles for use with one or more fashion dolls. Thus, practitioners have provided toy vehicles, campers, home environments, kitchen apparatus, fashion apparatus as well as hairplay and makeup accessories all intended to enhance the play value and appeal of fashion dolls. Perhaps one of the most important aspects of fashion doll product and accessory design which has emerged through the years is the need to provide some enhanced play value for fashion dolls rather than simply rely upon their highly attractive fashionable appearances and so on. Thus, dolls have been provided with extreme hairplay in which the child user is able to style the doll's hair as well as a wardrobe of interchangeable clothing articles and fashion accessories such as shoes, purses and jewelry. Despite the substantial efforts directed toward improving the appeal of fashion dolls which practitioners in the toy arts have made, there remains nonetheless a continuing need in the art for evermore improved, novel and interesting apparel and accessory features for fashion dolls.

SUMMARY OF THE INVENTION

The present invention provides clothing articles which may be worn by a fashion doll and which are configurable in at least two different configurations and appearances. The clothing articles are characterized by having a first configuration in which the garment is basically folded upwardly about the doll's body to enclose a portion of the doll's head and cover the doll body in an overlapping cover from approximately the lower torso to the top of the doll's head. In a second configuration, the clothing article is unfolded from its first configuration and is pulled downwardly upon the doll's torso and legs to provide a long skirt-like article of apparel which terminates at its lower end in a plurality of outwardly extending petal-like appendages. These petal-like appendages are flexible and somewhat filmy and give the doll an altered appearance which corresponds to a mermaid. The clothing article may be repeatedly converted between the two configurations for continuous and extended child play.

In one embodiment, a reconfigurable doll assembly comprises a doll including a body having an upper portion with a head, and a leg portion, and a clothing article movably mounted on the doll, the clothing article being movable relative to the body of the doll between a first configuration and a second configuration, the clothing article having a body portion with a first end portion and a second end portion, the first end portion remaining in contact with the body of the doll while the clothing article is moved between its first configuration and its second configuration, the second end portion being located proximate to the leg portion in the second configuration and being located above the head of the body in the first configuration.

In one embodiment, the clothing article in the second configuration creates the appearance of a portion of a mermaid, and the clothing article in the first configuration forms a hood for the head of the doll body.

In another embodiment, the second end portion includes a first distal tip portion and a second distal tip portion, the first distal tip portion and the second distal tip portion being oriented away from each other in the second configuration, and the first distal tip portion and the second distal tip portion being coupled together in the first configuration. In addition, the first distal tip portion and the second distal tip portion are oriented laterally from the body in the second configuration. Alternatively, each of the first distal tip portion and the second distal tip portion includes a coupling mechanism, the coupling mechanisms of the distal tip portions being engageable with each other to retain the clothing article in the second configuration.

In one embodiment, the first end portion frictionally engages the body of the doll when the clothing article is moved between the first configuration and the second configuration.

In one embodiment, the doll body has a waist portion and the first end portion remains in contact with the waist portion when the clothing article is moved between the first configuration and the second configuration.

In one embodiment, the body portion of the clothing article includes a first opening and a second opening formed therein, and the doll body includes a first arm and a second arm, the first opening receiving the first arm and the second opening receiving the second arm when the clothing article is in its first configuration. In an alternative embodiment, the clothing article is placeable in a third configuration, the first arm and second arm being engaged with the first opening and the second opening, respectively, when the clothing article is in the third configuration, and the second end portion includes a first distal tip portion and a second distal tip portion, each of the distal tip portions extending outward from the doll body when the clothing article is in its third configuration.

In one embodiment, a doll assembly comprises a doll having a torso portion, a leg portion, a first arm, a second arm, and a head, and a reconfigurable clothing article movably mounted on the doll, the clothing article is placeable in a lowered configuration in which the clothing article is proximate to the leg portion of the doll, and the clothing article is placeable in a raised configuration in which the clothing article is proximate to the torso portion of the doll, the clothing article receiving at least one of the first arm or the second arm while in the raised configuration.

In one embodiment, the clothing article covers substantially all of the leg portion of the doll when the clothing article is in its lowered configuration.

In one embodiment, the clothing article covers substantially all of the torso portion of the doll when the clothing article is in its raised configuration. In an alternative embodiment, the clothing article extends around a portion of the head when the clothing article is in its raised configuration.

In one embodiment, the clothing article includes a first opening and a second opening formed therein, the first opening receiving the first arm and the second opening receiving the second arm when the clothing article is in the raised configuration.

In one embodiment, the clothing article includes a body portion with a first end portion and a second end portion, the first end portion remaining in contact with the torso portion of the doll when the clothing article is moved between the lowered configuration and the raised configuration, the body portion having a first surface and a second surface opposite to the first surface, the first surface being oriented outward from the body in the first configuration, and the second surface being oriented outward from the body in the second configuration.

In one embodiment, a reconfigurable clothing article is provided for a doll that includes an upper portion, a middle portion, a lower portion, and a pair of arms coupled to the upper portion. The reconfigurable clothing article comprises a body portion including a first surface, a second surface opposite to the first surface, a first end portion coupled to the body portion, and a second end portion coupled to the body portion, the body portion being placeable in a first configuration in which the first end portion is located proximate to the middle portion of the doll and the second end portion covers the lower portion of the doll, and the body portion being placeable in a second configuration in which the first end portion is located proximate to the middle portion of the doll and the second end portion covers the upper portion of the doll.

In one embodiment, the second end portion includes a first tip and a second tip, the first tip being coupleable with the second tip when the clothing article is in its second configuration.

In one embodiment, the body portion includes a receiving area, one of the arms of the doll being engaged with the receiving area when the body portion is in the second configuration.

In one embodiment, the first end portion is stretchable.

In one embodiment, the doll body includes a surface with thermochromic indicia thereon.

BRIEF DESCRIPTION OF THE DRAWINGS

The present invention is shown in the various figures attached hereto in which each element maintains the same reference numeral in the various views shown herein and in which.

DESCRIPTION OF THE PREFERRED EMBODIMENT

By way of overview, the present invention provides transforming clothing articles for a fashion doll having a waist portion secured to the waist of the doll and an elongated generally narrow sheath-like skirt extending therefrom. The lower end of the elongated narrow skirt is freely movable and supports a plurality of petal-like projections formed of a flexible cloth material. A plurality of fasteners such as hook and loop type fabric fasteners are distributed upon the outer edges of the petals. The long narrow sheath-like skirt defines a slit extending upwardly from the lower end to approximately the knee location of the doll. The clothing article may be worn in a first configuration in which the lower end and petals are drawn upwardly upon the doll's leg and torso to embrace and wrap upon the doll's shoulders and head. In this position, the hook and loop fabric attachment pads cooperate to secure the petals about the doll's head and shoulders to resemble a clothing article such as a hooded sweatshirt or the like. In this configuration, the long sheath-like skirt is folded upon itself to overlie the waist attachment and doll torso. In the alternate configuration which corresponds to a mermaid, the petals are separated and drawn downwardly upon the doll's body such that the long sheath-like skirt extends from the doll's waist to the doll's feet. When so extended, the petals extend outwardly about the doll's feet to mimic the fins of a mermaid. The elongated slit extending from the petal area to the knee area of the skirt facilitates the configuration about the doll's head and shoulders in the hooded sweatshirt configuration.

More specifically, FIGS. 1 through 6 set forth sequential views of a fashion doll wearing a transforming clothing article constructed in accordance with the present invention being transformed from one configuration to the other.

Figure 1:
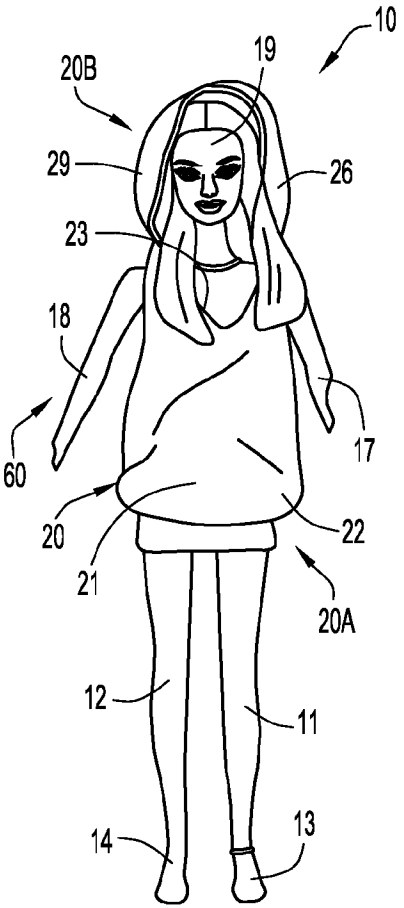
FIGS. 1 through 6 show sequential front views of a fashion doll wearing the present invention clothing article being converted from a fashion beach/sweatshirt type garment to a mermaid complete with tail fins.

FIG. 1 sets forth a front view of a fashion doll 10 constructed in accordance with general fabrication techniques and formed of a molded plastic material which is substantially rigid. Doll 10 is, in accordance with customary fabrication, articulated and thus has movable joints at the shoulders, hips and knees and so one to facilitate realistic play with the doll. Thus, doll 10 includes legs 11 and 12 having feet 13 and 14 thereon. Doll 10 also includes arms 17 and 18 and an upper portion with a head 19.

Doll or doll assembly 10 is shown wearing a clothing article generally referenced by numeral 20 which is fabricated in accordance with the present invention. The clothing article is reconfigurable as described below. Thus, clothing article 20 is formed of flexible cloth material and defines a waist band 21 secured to waist 15 of doll 10. The waist band 21 can be stretchable and slid onto the waist 15. In one implementation, the waist band 21 can be referred to as an end portion 20A of the clothing article 20. The clothing article 20 has another end portion 20B, which in this configuration, is located proximate to the head 19 of the doll. As the clothing article 20 is reconfigured as described below, the end portion 20A frictionally engages and remains in contact with the body of the doll 10.

In FIG. 1, the clothing article 20 is illustrated as being in an upper or raised configuration 60. Clothing article 20 further includes a skirt 22 which in turns defines an elongated slit 23. As is better seen in FIGS. 5 and 6, clothing article 20 defines a plurality of petals 24 through 29 which extend from the lower portion of skirt 22. In the configuration of clothing article 20 shown in FIG. 1, skirt 22 is drawn upwardly upon doll 10 and is supported by the attachment of petals 26 through 29 (seen in FIGS. 5 and 6) in attachment about head 19. The attachment of petals 26 through 29 about head 19 is described below in FIG. 2 in greater detail. Suffice it to note here that hook and loop attachment pads or mechanisms are secured to the end portion of petals 24 through 29 to facilitate attachment between the petals to form a hood-like structure upon head 19. As a result, in the configuration of clothing article 20 shown in FIG. 1, clothing article 20 generally conforms to a hooded clothing article such as a beach jacket or sweatshirt in which the hood embraces a portion of the head 19 and the remainder of the garment 20 drapes downwardly upon the doll's torso. In this configuration 60, the clothing article 20 is proximate to the torso portion or upper portion of the doll 10 and extends around a portion of the head 19 of the doll 10.

Figure 2:
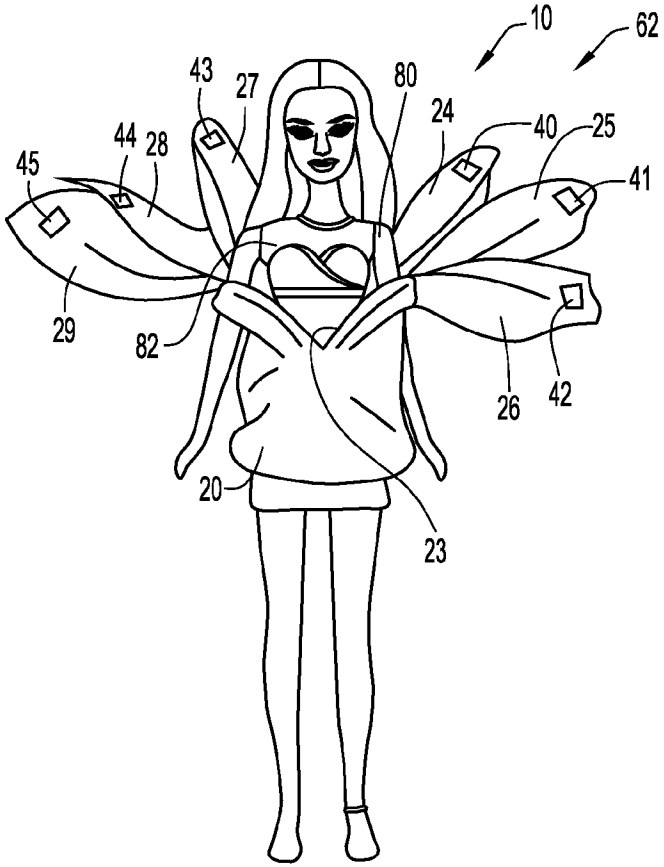
Figure 6:
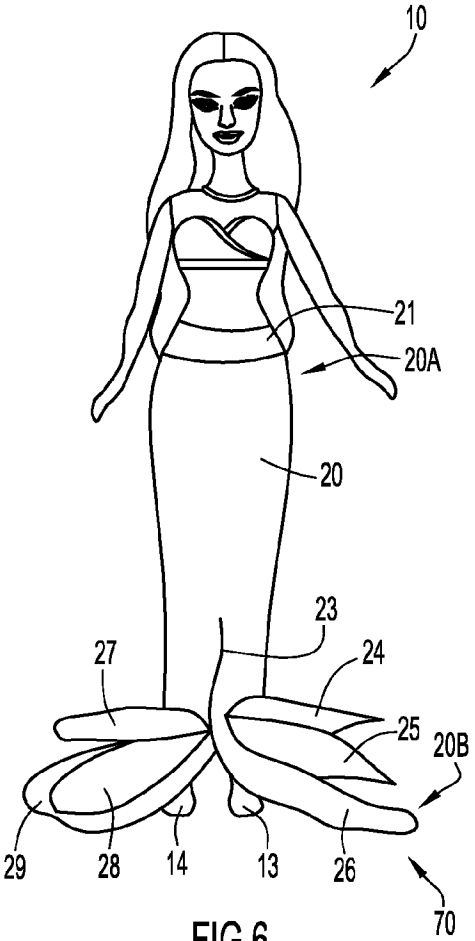
Figure 5:
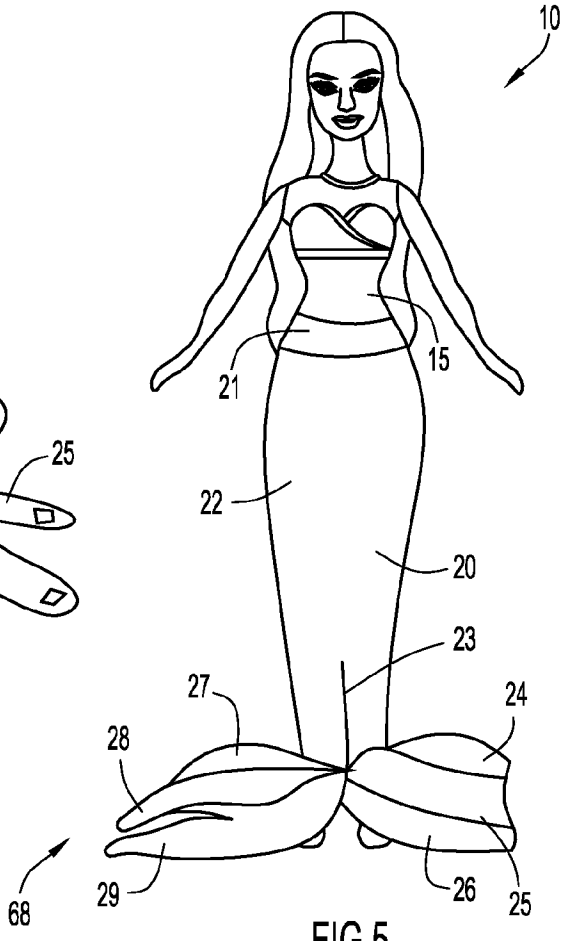

FIG. 2 sets forth a front view of doll 10 showing clothing article 20 at the initiation of its transformation from the hooded garment shown in FIG. 1 to the mermaid-like appearance shown in FIGS. 5 and 6. The remaining end or end portion 20B of skirt 22 further includes a plurality of flexible petals 24 through 29 which extend outwardly from skirt 22. Petals 24 through 29 define or include cooperating hook and loop fastening pads or mechanisms 40 through 45, respectively. Hook and loop attachment pads or mechanisms 40 through 45 may be fabricated utilizing virtually any conventional fastener such as metal snaps or the like. However, it has been found advantageous to employ the hook and loop fastening pads of the type sold under the trademark "Velcro."

In the configuration shown in FIG. 2, the transformation from the hooded garment shown in FIG. 1 to the mermaid shown in FIGS. 5 and 6 has been initiated by separating attachment pads 40 through 45 allowing petals 24 through 29 to separate. As petals 24 through 29 are separated and slit 23 is opened, garment 20 may be drawn downwardly upon doll 10 leaving waistband 21 secured to and proximate to the waist 15 of the doll 10. In FIG. 2, the clothing article 20 is illustrated in an intermediate configuration 62 in which the portion of the clothing article 20 with the petals 24 through 29 is located proximate to the shoulders 80 and 82 of the doll 10. As described below, the clothing article 20 includes a body portion with openings or receiving areas formed therein. The arms 17 and 18 of the doll are inserted into the openings of the body portion and in this configuration 62, the arms 17 and 18 remain inserted into the openings. The petals 24 through 29 can be arranged so that they extend laterally away from the petals on the other side of the doll and laterally outward relative to the body of the doll 10 and in particular, the shoulders 80 and 82 of the doll 10. This configuration 62 provides a different ornamental appearance of the garment 20 on the doll 10.

Figure 3:
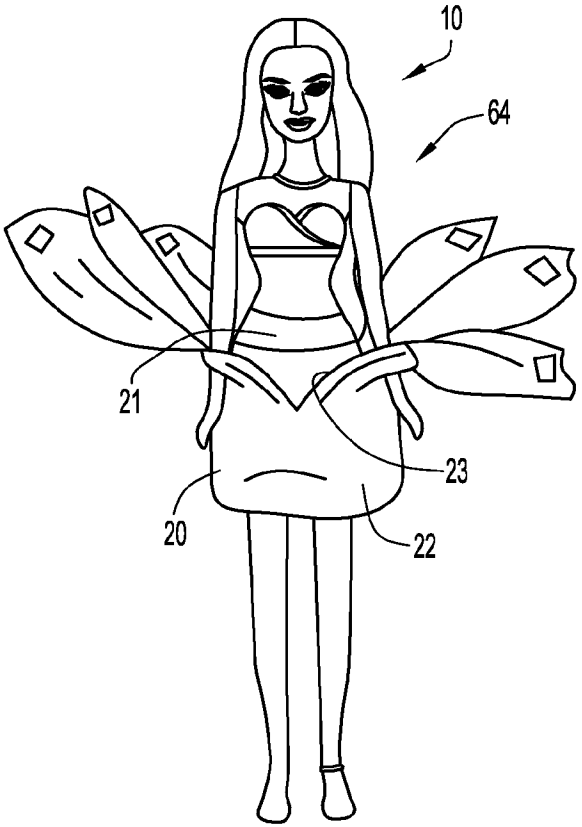

FIG. 3 sets forth a front view of doll 10 showing garment 20 having been moved downwardly upon doll 10. In this arrangement, the clothing article or garment 20 is moved to another intermediate configuration 64. In configuration 64, the garment 20 is moved downward along the body of the doll 10 as compared to configuration 62. Thus, garment 20 remains secured to doll 10 at waistband 21 while petals 24 through 29 and the portion of the garment 20 proximate to the petals 24 and 29 are drawn further downwardly upon doll 10. In the configuration 64 shown, garment 20 which includes skirt 22 defining slit 23 has petals 24 through 29 extending outwardly. As mentioned above, petals 24 through 29 define or include respective attachment pads or mechanisms 40 through 45.

Figure 4:
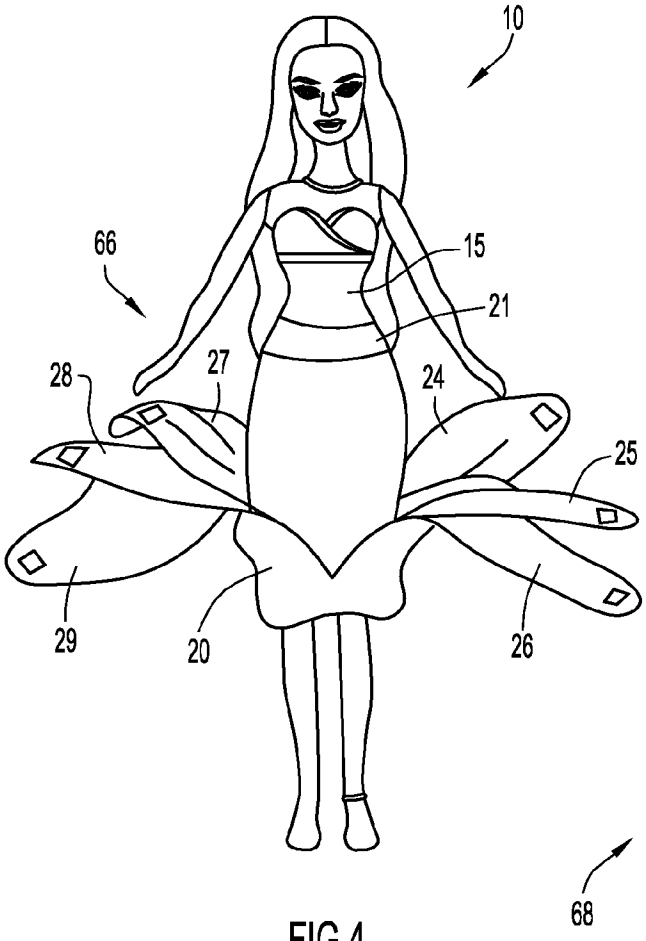

FIG. 4 sets forth a further sequential front view of doll 10 supporting garment 20 in a further transformation of the garment. In the configuration shown in FIG. 4, which is a lowered configuration 66, the downward movement of skirt 22 and petals 24 through 29 upon the lower torso or waist or waist portion 15 and legs of doll 10 has continued. In this configuration 66, the portion of the garment 20 to which the petals 24 through 29 are coupled is moved to a position lower than the waistband 21 of the garment 20. The waistband 21 remains in a consistent location on the torso of the doll 10 while the garment 20 moves between the configurations illustrated in FIGS. 1 through 6.

FIG. 5 sets forth a front view of doll 10 supporting garment 20 nearing completion of the transformation from the configuration shown in FIG. 1 to the mermaid configuration shown in FIG. 6. In this configuration 68, which can be referred to as a lowered configuration, the garment 20 has been moved so that the garment 20 covers the leg portion or legs 11 and 12 of the doll 10. In addition, the portion of the garment 20 to which the petals 24 through 29 are coupled is located proximate to the lower ends of the legs or the feet 13 and 14 of the doll 10. In this configuration 68, the garment 20 creates a mermaid-like appearance.

FIG. 6 sets forth a front view of doll 10 supporting clothing article 20 in its mermaid configuration 70. The mermaid configuration illustrated in FIG. 6 can be referred to alternatively as a lowered configuration. The waistband 21 of the clothing article 20 is secured or coupled to the waist 15 or torso of the doll. In this configuration 70, end portion 20B is located proximate to the lower end or feet of the doll and end portion 20A is located in its general position proximate to the middle or middle portion of the doll.

The elongated narrow skirt 22 of the clothing article 20 extends downwardly upon legs 11 and 12 of doll 10, as shown in FIG. 6. In the final mermaid configuration shown in FIG. 6, the slit 23 is basically closed to complete the mermaid transformation while petals 24 through 29 extend outwardly to replicate the tail fins of a mermaid. The closure of slit 23 may be provided utilizing virtually any type of conventional fabric attachment. In one implementation, the coupling mechanisms on corresponding ones of the petals 24 through 29 can be used to close the slit 23, which is located on both the front and the back of the doll 10. The coupling mechanisms can be hook and loop-type materials, snaps, magnets, buttons, an adhesive, or similar coupling structures.

It will be apparent to those skilled in the art that the transformation shown in FIGS. 1 through 6 which transforms clothing article 20 from a hooded jacket or sweatshirt to a mermaid configuration may be reversed to return the present invention clothing article to the configuration shown in FIG. 1. In such reversal, the user simply separates the slit 23 and draws the petals 24 through 29 upwardly about the legs and torso of doll 10. As skirt 22 is drawn upwardly, the skirt 22 rolls upon itself to facilitate this movement. Thereafter, petals 24 through 29 are secured upon head 19 in the manner shown in FIG. 1.

Figures 7, 8, 9, 10:
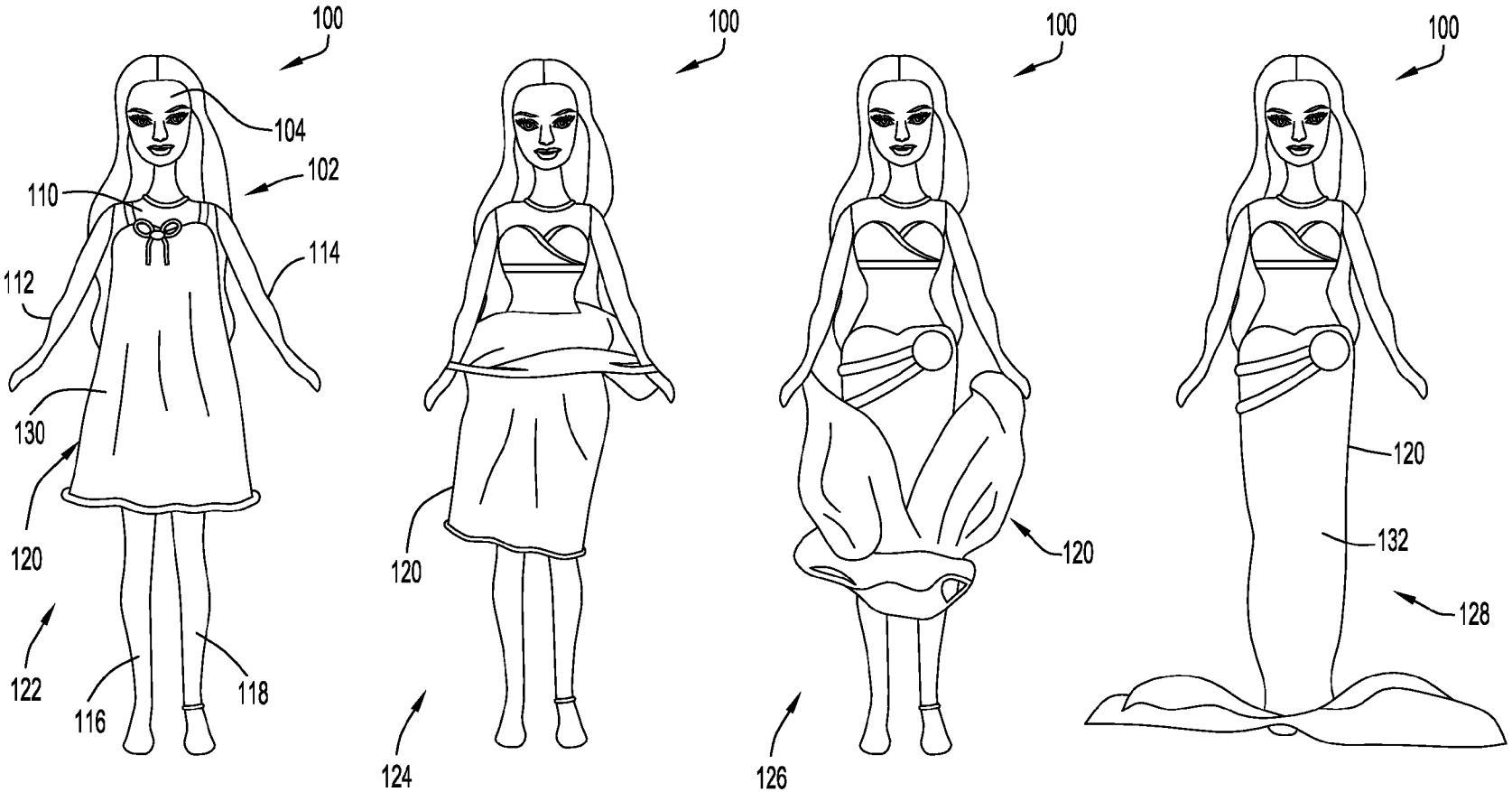
FIGS. 7 through 10 set forth sequential front views of a fashion doll having an alternate embodiment clothing article which is converted from a sundress configuration to a mermaid complete with a plurality of lower fins.
Figure 13:
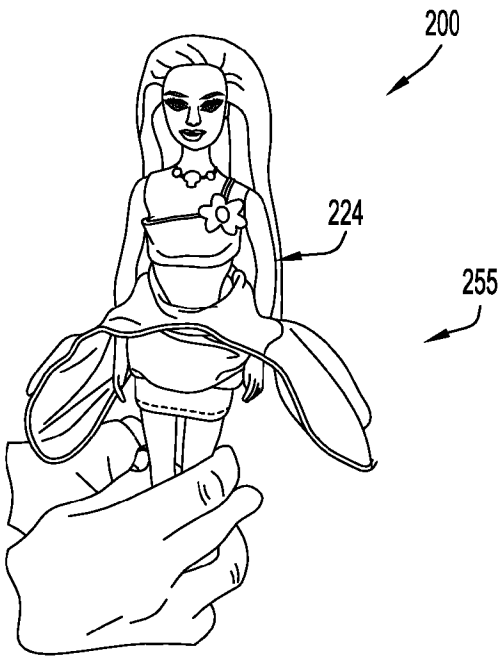
FIGS. 12 and 13 illustrate front views of the doll illustrated in FIG. 11 with the clothing article in different intermediate configurations.
Figure 12:
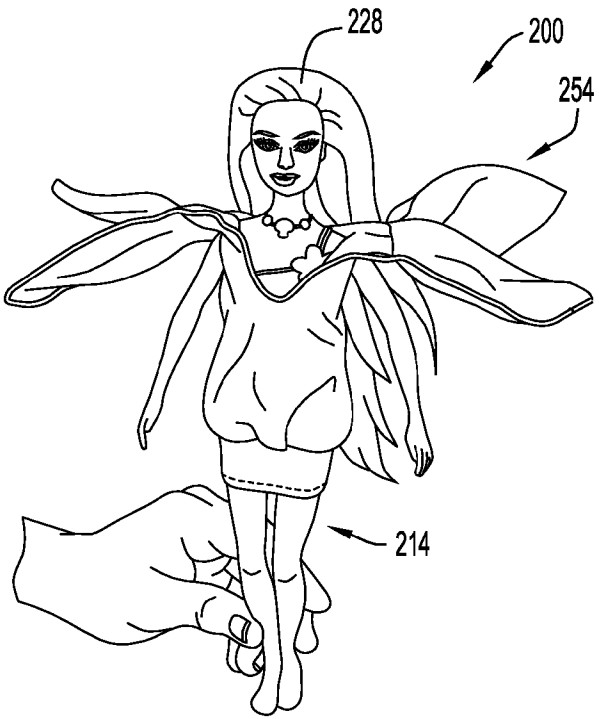
Figure 11:
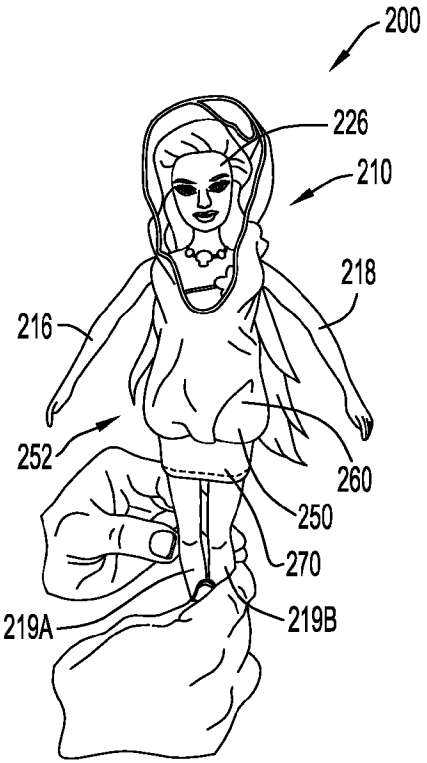
FIG. 11 illustrates a front view of another embodiment of a doll with a clothing article in an upper configuration.

FIGS. 7 through 10 show similar sequential views of a conventional fashion doll utilizing an alternate embodiment of the present invention clothing article which as can be seen is convertible from a sundress-like configuration in FIG. 7 to the mermaid configuration shown in FIG. 10. The embodiment of FIGS. 7 through 10 does not utilize the attachment of petals to form a hood, but rather folds the petals into the sundress bodice portion in the configuration shown in FIG. 7.

As shown in FIG. 7, the doll or doll assembly 100 includes a doll body 102 that includes a head 104 coupled to a torso portion 110. A pair of arms 112 and 114 and a pair of legs 116 and 118 are coupled to the torso portion 110 as well. The doll 100 includes an article of clothing or garment 120 that is coupled to the body 102 and is reconfigurable between an upper or sundress-like configuration 122 (illustrated in FIG. 7) and a mermaid or lower configuration 128 (illustrated in FIG. 8). The clothing article 120 can be moved from the sundress-like configuration 122 in FIG. 7 to intermediate configurations 124 (see FIG. 8) and 126 (see FIG. 9) to the mermaid or lower configuration 128 (see FIG. 10). When desired, a user can move the clothing article 120 in the opposite direction from configuration 128 to configuration 122.

The article of clothing 120 has a first surface 130 and a second surface 132 opposite to the first surface 130. As illustrated in FIGS. 7 and 10, the particular surface that is oriented outward and away from the doll body 102 depending on the configuration of the clothing article 120. Thus, the appearance of the doll 100 can change based on the displayed surface 130 or 132. In configuration 122, surface 130, which includes a material pattern resembling a dress or a sun-dress, is oriented outward. However, in configuration 128, surface 132, which includes a pattern resembling a portion of the body of a mermaid, is oriented outward. The inversion of the clothing article 120 to change the displayed surface occurs during the transformation between configurations 122 and 128.

Figure 14:
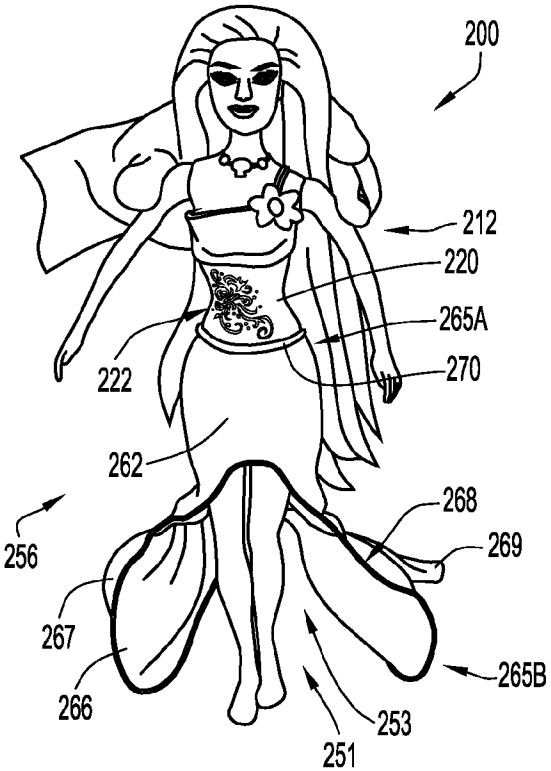

Referring to FIGS. 11-16, an alternative embodiment of a doll or doll assembly according to the invention is illustrated. In this embodiment, the doll 200 is similar to the doll 10 illustrated in FIGS. 1-6 and accordingly, many of the similar features or components are not described in detail for FIGS. 11-16. The doll 200 includes a doll body 210 with an upper or torso portion 212 (see FIG. 14) and a lower or leg portion 214 (see FIG. 12), which may include two legs 219A and 219B. Coupled to the torso portion 212 are arms 216 and 218. As shown in FIG. 14, the torso portion 212 includes an outer surface 220 on which indicia 222 is provided. In one implementation, the indicia 222 can made using a thermochromic material that changes color and/or becomes visible in response to a change in temperature. In this embodiment, similarly functioning indicia 224 (see FIG. 13) can be included on arm 218 as well. The doll body 210 includes a head 226 with hair 228 (see FIG. 12), which in one embodiment, may be configured to change colors in response to the application of water, a change in temperature, and/or contact by a particular device or mechanism.

The doll 200 includes an article of clothing or garment 250. The garment 250 is coupled to a waistband or mounting portion 270 that is coupled to the doll body 210. The garment 250 has a surface 260 that is exposed or visible when the garment is in configuration 252, which can be referred to alternatively as an upper configuration or hood configuration. The garment 250 can be moved to configuration 254 (see FIG. 12) in which an end of the garment 250 is located proximate to the shoulders of the doll body 210. The end of the garment 250 can be moved so that it is proximate to the waist of the doll body 210 in the configuration 255 illustrated in FIG. 13. In configurations 252, 254, and 255, the arms 216 and 218 of the doll body 210 are inserted into and engaged with openings or receiving areas in the garment 250.

The garment 250 can be placed in another configuration 256, such as a dress-like configuration, as illustrated in FIG. 14. In this configuration 256, the body portion of the garment 250 is moved so that part of the mounting portion 270 and surface 262 is visible. The garment 250 generally resembles a dress in this configuration 256. The garment 250 includes a body portion 264 with two end portions 265A and 265B. In this embodiment, end portion 265B includes distal tip portions or tips 266 and 268 that are separated by a front slit 251 and a rear slit 253. In this embodiment, each portion 266 and 268 resembles a petal. The portions 266 and 268 include additional members 267 and 269, respectively, that are mounted to the portions 266 and 268.

Figure 15:
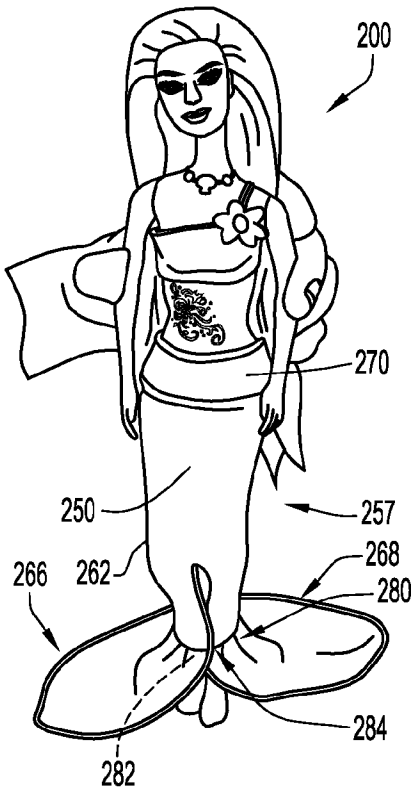

Referring to FIG. 15, the garment 250 is moved to a configuration 257 in which it is lowered and covers the lower or leg portion of the doll. In this configuration 257, the garment 250 resembles the lower portion of a mermaid and the portions 266 and 268 of the garment 250 are coupled to each other in a coupling area or region 280 via coupling mechanisms 282 and 284 on the portions 266 and 268. The coupling mechanisms 282 and 284 can be hook and loop-type materials that are adhered, stitched, sewn, or otherwise coupled to the portions 266 and 268. By coupling the portions 266 and 268 together, the slits 251 and 253 are closed and the feet of the doll are covered or essentially covered, thereby creating the appearance of a mermaid.

Figure 16:
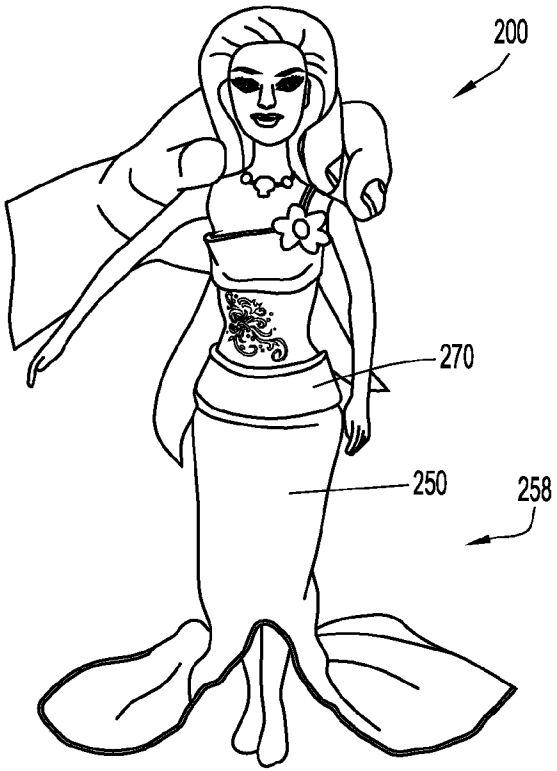
FIGS. 14 through 16 illustrate front views of the doll illustrated in FIG. 11 with the clothing article in different lowered configurations.

Referring to FIG. 16, the portions 266 and 268 are decoupled from each other and can be moved slightly laterally as shown. In this configuration 258, substantially all of the lower or leg portion of the doll is covered by the garment.

Figure 17:
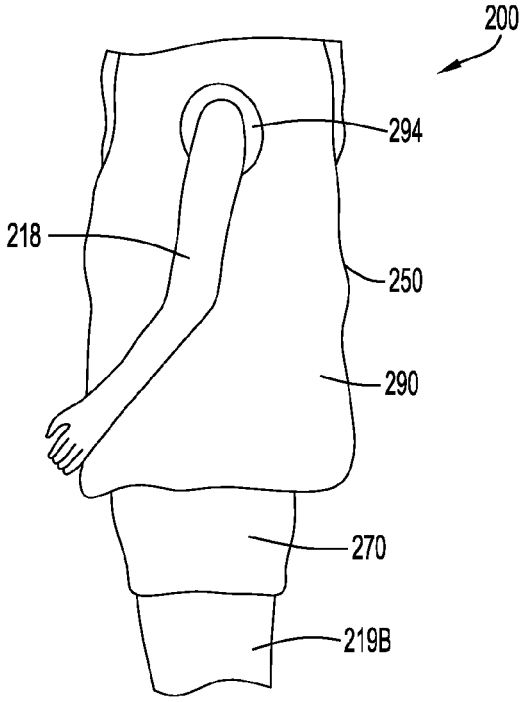
FIG. 17 illustrates a side view of a portion of the doll illustrated in FIG. 17.

Referring to FIG. 17, a side view of the doll 200 is illustrated. In this embodiment, the garment 250 includes a body or body portion 290 that has an opening 294 formed therein. The body portion 290 is coupled to the mounting portion 270 by stitching. As shown, the arm 218 of the doll 200 can be inserted into the opening 294 and retained therein until the body portion 290 is moved downward a sufficient distance to disengage the arm 218 from the opening 294.

Figure 18:
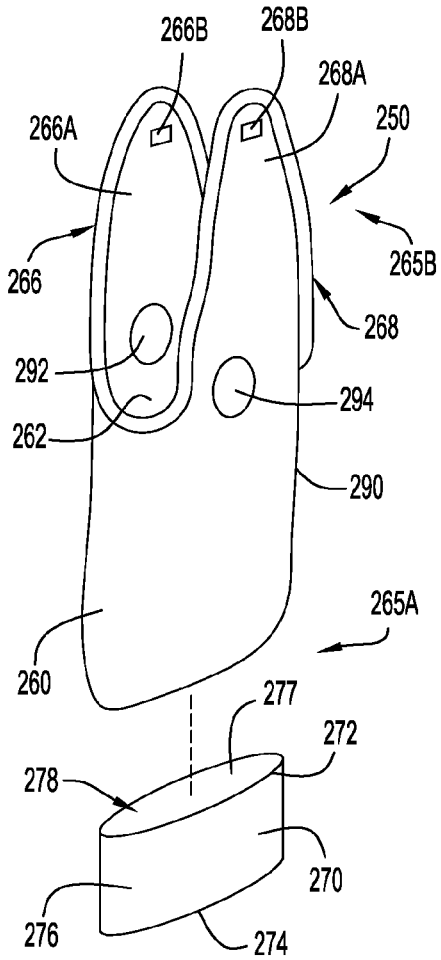
FIG. 18 illustrates a perspective view of an embodiment of a clothing article according to the invention.

Referring to FIG. 18, an embodiment of a clothing article is illustrated. In this embodiment, the clothing article or garment 250 includes a body portion 290 and a mounting portion 270. The mounting portion 270 is made of a stretchable material and has opposite ends 272 and 274. The mounting portion 270 includes an outer surface 276, to which the body portion 290 is attached, and an inner surface 277 defining an opening 278 in which a portion of the doll is received.

The body portion 290 includes openings 292 and 294 formed therein that are configured to receive the arms 216 and 218 of the doll, respectively. The garment 250 includes opposite surfaces 260 and 262 that are either displayed or hidden based on the configuration of the garment 250. As mentioned above, the garment 250 includes portions 266 and 268 that can be located proximate to and above the head of the doll, proximate to the feet of the doll, or at a position therebetween. In this embodiment, end portion 266 has an inner surface 266A with a coupling mechanism 266B coupled thereto. In addition, end portion 268 has an inner surface 268A with a coupling mechanism 268B coupled thereto. When the end portions 266 and 268 are moved to their upper positions, the end portions 266 and 268 can be connected to each other in a hood-like configuration and retained in that configuration by engaging the coupling mechanisms 266B and 268B together.

In alternative embodiments, the quantity and location of the coupling mechanisms on the end portions can vary. In addition, the quantity and configuration of the petals or tips of the garment coupled to the doll can vary in different embodiments.

What has been shown is a clothing article for use with a fashion doll which is convertible between an article of clothing to a mermaid appearance.

What is claimed is:

1. A reconfigurable doll assembly, comprising:

a doll including a body having an upper portion with a head, a pair of arms, and a leg portion; and a clothing article movably mounted on the doll, the clothing article being movable relative to the body of the doll between a first configuration and a second configuration, the clothing article having a body portion with a first end portion and a second end portion including a first tip portion and a second tip portion, each of the first tip portion and second tip portion includes a proximal end and a distal end, the proximal ends of the first tip portion and second tip portion are coupled to the second end portion of the clothing article, the first end portion remaining in contact with the body of the doll while the clothing article is moved between its first configuration and its second configuration, the second end portion being located above the head of the body with the distal end of the first tip portion and the distal end of the second tip portion coupled together in the first configuration, and the second end portion being located proximate to the leg portion with the first tip portion and the second tip portion uncoupled and oriented away from each other in the second configuration.

2. The reconfigurable doll assembly of claim 1, wherein the clothing article in the second configuration creates the appearance of a portion of a mermaid, and the clothing article in the first configuration forms a hood for the head of the doll body.

3. The reconfigurable doll assembly of claim 1, wherein the first tip portion and the second tip portion are oriented laterally from the body in the second configuration.

4. The reconfigurable doll assembly of claim 1, wherein each of the distal end of the first tip portion and the distal end of the second tip portion includes a coupling mechanism, the coupling mechanisms of the distal ends being engageable with each other to retain the clothing article in the second configuration.

5. The reconfigurable doll assembly of claim 1, wherein the first end portion frictionally engages the body of the doll when the clothing article is moved between the first configuration and the second configuration.

6. The reconfigurable doll assembly of claim 1, wherein the doll body has a waist portion and the first end portion remains in contact with the waist portion when the clothing article is moved between the first configuration and the second configuration.

7. The reconfigurable doll assembly of claim 1, wherein the body portion of the clothing article includes a first opening and a second opening formed therein, and the doll body includes a first arm and a second arm, the first opening receiving the first arm and the second opening receiving the second arm when the clothing article is in its first configuration.

8. The reconfigurable doll assembly of claim 7, wherein the clothing article is placeable in a third configuration, the first arm and second arm being engaged with the first opening and the second opening, respectively, when the clothing article is in the third configuration.

9. A doll assembly, comprising:

a doll having a torso portion, a leg portion, a first arm, a second arm, and a head; and a reconfigurable clothing article movably mounted on the doll, the clothing article including a first end, a second end, and arm openings disposed on the clothing article between the first end and the second end, the clothing article is placeable in a lowered configuration in which the second end of the clothing article is proximate to the leg portion of the doll, and the clothing article is placeable in a raised configuration in which the second end of the clothing article is proximate to the torso portion of the doll, the first end remaining in contact with the torso portion of the doll when the clothing article is moved between the lowered configuration and the raised configuration, the arm openings of the clothing article receiving at least one of the first arm or the second arm while in the raised configuration, and the arm openings being spaced apart from the first arm and the second arm while in the lowered configuration.

10. The doll assembly of claim 9, wherein the clothing article covers substantially all of the leg portion of the doll when the clothing article is in its lowered configuration.

11. The doll assembly of claim 9, wherein the clothing article covers substantially all of the torso portion of the doll when the clothing article is in its raised configuration.

12. The doll assembly of claim 11, wherein the clothing article extends around a portion of the head when the clothing article is in its raised configuration.

13. The doll assembly of claim 9, wherein the arm openings include a first opening and a second opening, the first opening receiving the first arm and the second opening receiving the second arm when the clothing article is in the raised configuration.

14. The doll assembly of claim 9, wherein the clothing article-includes a body portion the body portion having a first surface and a second surface opposite to the first surface, the first surface being oriented outward from the body portion in the first configuration, and the second surface being oriented outward from the body portion in the second configuration.

15. The doll assembly of claim 14, wherein the arm openings are located proximate to the second end, and each of the arm openings receives one of the first arm and the second arm when the clothing article is in the raised configuration.

16. A reconfigurable clothing article for a doll, the doll including an upper portion, a middle portion, a lower portion, a head coupled to the upper portion, and a pair of arms coupled to the upper portion, the clothing article comprising:

a body portion including:

a first surface;

a second surface opposite to the first surface;

a first end portion coupled to the body portion;

a second end portion coupled to the body portion; and a pair of arm openings disposed on the body portion proximate to the second end portion, the body portion being placeable in a first configuration in which the first end portion is located proximate to the middle portion of the doll and the second end portion covers the lower portion of the doll, and the body portion being placeable in a second configuration in which the first end portion is located proximate to the middle portion of the doll, the second end portion covers the upper portion of the doll, including the head, and the pair of arm openings receive the pair of arms of the doll.

17. The reconfigurable clothing article of claim 16, wherein the second end portion includes a first tip and a second tip, the first tip being coupleable with the second tip when the clothing article is in its second configuration.

18. The reconfigurable clothing article of claim 16, wherein the first end portion is stretchable.

19. The reconfigurable clothing article of claim 16, wherein the doll includes a surface with thermochromic indicia thereon.

20. The reconfigurable clothing article of claim 17, wherein the body portion is placeable in a third configuration, the pair of arms being received by the pair of arm openings when the clothing article is in the third configuration, and the first tip and the second tip are uncoupled and extending outward from the doll when the body portion is in its third configuration.

* * * * *